US009921017B1

(12) United States Patent
Kley

(10) Patent No.: US 9,921,017 B1
(45) Date of Patent: Mar. 20, 2018

(54) USER IDENTIFICATION FOR WEAPONS AND SITE SENSING FIRE CONTROL

(71) Applicant: Victor B. Kley, Berkeley, CA (US)

(72) Inventor: Victor B. Kley, Berkeley, CA (US)

( * ) Notice: Subject to any disclaimer, the term of this patent is extended or adjusted under 35 U.S.C. 154(b) by 0 days.

(21) Appl. No.: 15/295,902

(22) Filed: Oct. 17, 2016

Related U.S. Application Data

(63) Continuation-in-part of application No. 14/203,440, filed on Mar. 10, 2014, now Pat. No. 9,470,485.

(60) Provisional application No. 61/787,459, filed on Mar. 15, 2013.

(51) Int. Cl.

| | |
|---|---|
| ***F41A 19/00*** | (2006.01) |
| ***F41A 17/06*** | (2006.01) |
| ***F41A 17/08*** | (2006.01) |
| ***F41A 19/10*** | (2006.01) |
| ***F41H 13/00*** | (2006.01) |

(52) U.S. Cl.
CPC ..... *F41A 17/066* (2013.01); *F41A 17/063* (2013.01); *F41A 17/08* (2013.01); *F41A 19/10* (2013.01); *F41H 13/0043* (2013.01)

(58) Field of Classification Search
CPC ..... F41A 17/066; F41A 17/063; F41A 17/08; F41A 19/10; F41H 13/0043
USPC ..... 42/69.01
See application file for complete search history.

(56) References Cited

U.S. PATENT DOCUMENTS

| | | | |
|---|---|---|---|
| 123,352 | A | 2/1872 | Milbank |
| 2,041,253 | A | 5/1936 | Leussler |
| 2,177,928 | A | 10/1939 | Knudsen |
| 2,336,065 | A | 12/1943 | Cadham |
| 2,654,319 | A | 10/1953 | Roske |
| 2,759,419 | A | 8/1956 | Hitchens et al. |
| 2,862,446 | A | 12/1958 | Ringdal |
| 2,918,868 | A | 12/1959 | Ringdal |
| 2,970,905 | A | 2/1961 | Doll |
| 2,987,775 | A | 6/1961 | Albrecht et al. |
| 2,995,090 | A | 8/1961 | Daubenspeck |

(Continued)

FOREIGN PATENT DOCUMENTS

| | | | |
|---|---|---|---|
| CH | 326592 | A | 12/1957 |
| DE | 2419881 | A1 | 12/1974 |

(Continued)

OTHER PUBLICATIONS

ASTM F2094 $Si_3N_4$ Cerbec Ball Specifications, Saint-Gobain Ceramics, downloaded from http://www.cerbec.com/TechInfo/TechSpec.asp on Feb. 8, 2005, 3 pages.

(Continued)

*Primary Examiner* — Samir Abdosh
(74) *Attorney, Agent, or Firm* — Kilpatrick Townsend & Stockton, LLP

(57) ABSTRACT

Firearms or other projectile weapons include a GPS sensor, World Time RF sensor, orientation sensor for detecting the angle, acceleration (launch velocity), and direction in which the projectile will be launched along with a stored updatable list of times, GPS coordinates, distances from the GPS coordinates such that the weapon is disabled for use in these restricted areas if the projectile shall enter the restricted area. In addition, acceleration is used to detect a dropped or potentially damaged weapon such that the weapon is disabled and an emergency RF beacon is enabled (alternatively selected by the user).

13 Claims, 3 Drawing Sheets

(56) References Cited

U.S. PATENT DOCUMENTS 3,026,802 A 3/1962 Barnet et al.
3,031,966 A 5/1962 Metzger
3,099,958 A 8/1963 Daubenspeck et al.
3,123,003 A 3/1964 Lange, Jr. et al.
3,144,827 A 8/1964 Boutwell
3,257,948 A 6/1966 Axelrod et al.
3,292,492 A 12/1966 Sturtevant
3,340,809 A 9/1967 Stadler et al.
3,424,089 A 1/1969 Humpherson
3,491,423 A 1/1970 Haller
3,559,581 A 2/1971 Kriz et al.
3,628,225 A 12/1971 Parker
3,659,528 A 5/1972 Santala
3,745,924 A 7/1973 Scanlon
3,786,755 A 1/1974 Eckstein et al.
3,797,396 A 3/1974 Reed
3,842,739 A 10/1974 Scanlon et al.
3,874,294 A 4/1975 Hale
3,935,816 A 2/1976 Boquette, Jr.
3,955,506 A 5/1976 Luther et al.
3,977,326 A 8/1976 Anderson et al.
3,990,366 A 11/1976 Scanlon
4,020,763 A 5/1977 Iruretagoyena
4,023,465 A 5/1977 Inskip
4,054,637 A 10/1977 Gruaz
4,057,168 A 11/1977 Bosshold
4,140,058 A 2/1979 Ballreich et al.
4,147,107 A 4/1979 Ringdal
4,149,465 A 4/1979 Verkozen
4,150,089 A 4/1979 Linet
4,170,071 A 10/1979 Mann et al.
4,187,271 A 2/1980 Rolston et al.
4,192,233 A 3/1980 Dumortier
4,216,722 A 8/1980 Angell
4,323,420 A 4/1982 Masnari et al.
4,325,190 A 4/1982 Duerst
4,390,567 A 6/1983 Liepins
4,444,717 A 4/1984 de Breze
4,455,942 A 6/1984 Murray et al.
4,498,396 A 2/1985 Berube
4,508,036 A 4/1985 Jensen et al.
4,565,131 A 1/1986 Buchner
4,569,288 A 2/1986 Grelle et al.
4,572,078 A 2/1986 Bell
4,593,621 A 6/1986 Buchner
4,614,157 A 9/1986 Grelle et al.
4,624,641 A 11/1986 Gallagher
4,637,520 A 1/1987 Alvi
4,726,296 A 2/1988 Leshner et al.
4,732,364 A 3/1988 Seger et al.
4,738,202 A 4/1988 Hebert
4,809,612 A 3/1989 Ballreich et al.
4,886,177 A 12/1989 Foster
4,913,054 A 4/1990 Petersen
4,928,598 A 5/1990 Sabranski et al.
4,948,371 A 8/1990 Hall
5,021,206 A 6/1991 Stoops
5,033,386 A 7/1991 Vatsvog
5,060,391 A 10/1991 Cameron et al.
5,063,853 A 11/1991 Bilgeri
5,097,768 A 3/1992 Petrovich
5,114,745 A 5/1992 Jones
5,151,555 A 9/1992 Vatsvog
5,215,465 A 6/1993 Marshall et al.
5,237,930 A 8/1993 Belanger et al.
5,239,928 A 8/1993 Ricci
5,259,288 A 11/1993 Vatsvog
5,316,479 A 5/1994 Wong et al.
5,425,299 A 6/1995 Teetzel
5,476,385 A 12/1995 Parikh et al.
5,517,896 A 5/1996 Perrine
5,551,876 A 9/1996 Koresawa et al.
5,563,365 A 10/1996 Dineen et al.
5,602,439 A 2/1997 Valone
5,603,179 A * 2/1997 Adams ..... F41A 17/066 42/70.06
5,614,942 A 3/1997 Rom
5,616,642 A 4/1997 West et al.
5,667,852 A 9/1997 Kulik et al.
5,708,231 A 1/1998 Koon
5,760,331 A 6/1998 Lowden et al.
5,782,028 A 7/1998 Simon et al.
5,784,821 A 7/1998 Gerard
5,792,556 A 8/1998 Ishikura et al.
5,825,386 A 10/1998 Ohashi
5,858,477 A 1/1999 Veerasamy et al.
5,869,133 A 2/1999 Anthony et al.
5,915,936 A * 6/1999 Brentzel ..... F41A 17/063 42/70.11
5,937,557 A 8/1999 Bowker
5,937,558 A 8/1999 Gerard
5,969,288 A 10/1999 Baud
6,041,712 A 3/2000 Lyon
6,048,379 A 4/2000 Bray et al.
6,074,454 A 6/2000 Abrams et al.
6,084,340 A 7/2000 Bachmann et al.
6,101,949 A 8/2000 Maucourt et al.
6,110,594 A 8/2000 Pinneo
6,131,519 A 10/2000 Thiesen et al.
6,144,028 A 11/2000 Kley
6,199,286 B1 3/2001 Reed, Jr. et al.
6,210,625 B1 4/2001 Matsushita et al.
6,230,431 B1 5/2001 Bear
6,237,494 B1 5/2001 Brunet et al.
6,252,226 B1 6/2001 Kley
6,257,149 B1 7/2001 Cesaroni
6,257,893 B1 7/2001 Trabut
6,286,240 B1 9/2001 Collins
6,290,726 B1 9/2001 Pope et al.
6,337,479 B1 1/2002 Kley
6,339,217 B1 1/2002 Kley
6,343,140 B1 1/2002 Brooks
6,412,207 B1 7/2002 Crye et al.
6,415,542 B1 7/2002 Bates et al.
6,439,123 B1 8/2002 Dionne et al.
6,481,140 B1 11/2002 Marshall
6,539,874 B2 4/2003 Weise
6,543,365 B1 4/2003 Vasel et al.
6,563,940 B2 5/2003 Recce
6,598,536 B2 7/2003 Burri
6,631,579 B1 10/2003 Lauster et al.
6,652,762 B2 11/2003 Baik et al.
6,663,391 B1 12/2003 Otowa
6,763,126 B2 7/2004 Recce
6,779,461 B1 8/2004 Olson et al.
6,823,621 B2 * 11/2004 Gotfried ..... F41A 17/066 42/70.01
6,845,716 B2 1/2005 Husseini et al.
6,854,975 B2 2/2005 Ranzinger
6,887,079 B1 5/2005 Robertsson et al.
6,925,742 B1 8/2005 Van Zyl
6,942,486 B2 9/2005 Lvovskiy
6,966,775 B1 11/2005 Kendir et al.
7,036,258 B1 5/2006 Lee et al.
7,132,129 B2 11/2006 van Enckevort et al.
7,204,191 B2 4/2007 Wiley et al.
7,213,519 B2 5/2007 Wiley et al.
7,281,397 B2 10/2007 Victor
7,363,742 B2 4/2008 Nerheim
7,441,362 B1 10/2008 Kley
7,926,408 B1 4/2011 Kley
8,297,191 B2 10/2012 Schaefer et al.
8,621,774 B1 1/2014 Kley
8,966,797 B2 * 3/2015 Carlson ..... F41A 17/063 42/1.01
9,032,855 B1 5/2015 Foren et al.
9,200,880 B1 12/2015 Foren et al.
9,341,425 B2 * 5/2016 Carlson ..... F41A 17/063
9,470,485 B1 * 10/2016 Kley ..... F42B 5/30
2001/0042332 A1 11/2001 Gering
2002/0005138 A1 1/2002 Burri
2002/0014694 A1 2/2002 Olofsson
2002/0112390 A1 8/2002 Harling et al.

(56) References Cited

U.S. PATENT DOCUMENTS

| | | | | |
|---|---|---|---|---|
| 2003/0136043 | A1 | 7/2003 | Lauster et al. | |
| 2003/0163941 | A1 | 9/2003 | Herzog | |
| 2003/0205958 | A1 | 11/2003 | Schwind et al. | |
| 2004/0031180 | A1 | 2/2004 | Ivanov | |
| 2004/0071876 | A1 | 4/2004 | Rakhimov et al. | |
| 2004/0146840 | A1 | 7/2004 | Hoover et al. | |
| 2004/0180205 | A1 | 9/2004 | Scarsbrook et al. | |
| 2004/0234860 | A1 | 11/2004 | Qu et al. | |
| 2004/0258918 | A1 | 12/2004 | Chaffin, III | |
| 2006/0040104 | A1 | 2/2006 | Wort et al. | |
| 2006/0048432 | A1 | 3/2006 | Staley, III | |
| 2006/0152786 | A1 | 7/2006 | Takakuwa et al. | |
| 2006/0191182 | A1 | 8/2006 | Curry et al. | |
| 2007/0009860 | A1 | 1/2007 | Young | |
| 2007/0044365 | A1 | 3/2007 | Deken | |
| 2007/0077539 | A1 | 4/2007 | Tzidon et al. | |
| 2007/0084375 | A1 | 4/2007 | Smith | |
| 2007/0089598 | A1 | 4/2007 | Courty | |
| 2007/0104399 | A1 | 5/2007 | Hamza et al. | |
| 2007/0190495 | A1 | 8/2007 | Kendir et al. | |
| 2007/0238073 | A1 | 10/2007 | Portoghese et al. | |
| 2009/0064557 | A1 | 3/2009 | Hughes et al. | |
| 2009/0071055 | A1 | 3/2009 | Kley | |
| 2014/0259841 | A1* | 9/2014 | Carlson | F41A 17/063 42/1.01 |
| 2015/0153124 | A1* | 6/2015 | Carlson | F41A 17/063 42/70.02 |
| 2016/0021329 | A1* | 1/2016 | Sakiewicz | H04N 5/772 386/227 |
| 2016/0258701 | A1* | 9/2016 | Carlson | F41A 17/063 |
| 2017/0089673 | A1 | 3/2017 | Burrow | |

FOREIGN PATENT DOCUMENTS

| | | | |
|---|---|---|---|
| EP | 0131863 | A2 | 1/1985 |
| GB | 1015516 | | 1/1966 |
| GB | 2044416 | A | 10/1980 |
| SU | 1045777 | A | 12/1981 |
| TW | 399346 | B | 7/2000 |
| WO | 1988/009476 | A1 | 12/1988 |
| WO | 1989/007496 | A1 | 8/1989 |
| WO | 2003/087699 | A2 | 10/2003 |

OTHER PUBLICATIONS

Biener et al., "Diamond Ablators for Inertial Confinement Fusion," Lawrence Livermore National Laboratory, UCRL-JRNL-213214, 23 pages (2005).

"Bullet" definition, Compact Oxford English Dictionary, downloaded on Feb. 13, 2009 from http://www.askoxford.com/concise_oed/cullet?view=uk, 1 page.

Culver et al., "Velocity and Pressure Effects on Projectiles due to Variation of Ignition Parameters," Naval Postgraduate School, Master of Science in Physics thesis, NTIS No. 757278 (1972), available at http://www.dtic.mil/dtic/tr/fulltext/u2/757278.pdf.

Drory, "Performance of Diamond-Coated Silicon Nitride Bearings," Journal of Spacecraft 34(5): 683-684 (1997).

"Germanium on Silicon Near Infrared Photodetectors," Universita di Roma, downloaded from http://optow.ele.uniroma3.it/optow_2002/labs/SiGeNIR%20files/SiGeNIR.htm on Feb. 8, 2005, 12 pages.

Kilkenny et al., "From One-of-a-Kind to 500,000 High Quality Ignition Targets Per Day," Twentieth IAEA Fusion Energy Conference, 9 pages (2004).

Komanduri, "Finishing of Silicon Nitride Balls," Oklahoma State University, downloaded from http://asset.okstate.edu/asset/finish.htm on Oct. 24, 2005, 2 pages.

Martinelli et al., "The Application of Semiconductors with Negative Electron Affinity Surfaces to Electron Emission Devices," Proceedings of the IEEE 62(10): 1339-1360 (1974).

Mikko, "U.S. Military 'Green Bullet': A Technical Report," Association of Firearm and Tool Mark Examiners Journal 31(4) (1999), available at http://www.firearmsid.com/Feature%20Articles/GreenBullets/GreenBullets.htm.

Lindl, "Development of the Indirect-Drive Approach to Intertial Confinement Fusion and the Target Physics Basis for Ignition and Gain," Physics of Plasmas 2(11): 3933-4024.

London et al., "Thermal Infrared Exposure of Cryogenic Indirect Drive ICF Targets," Lawrence Livermore National Laboratory, UCRL-JRNL-213603, 9 pages (2005).

Peterson, "Intertial Fusion Energy: A Tutorial on the Technology and Economics," downloaded from http://www.engineeringpathway.com/engpath/ep/learning_resource/summary/Summary?id=960BAD65-9529-4623-9C5B-891A7651310D, 2 pages.

Peterson, "Output Spectra from Direct Drive ICF Targets," Fusion Technology Institute, University of Wisconsin-Madison, Laser IFE Workshop, available at http://fti.neep.wisc.edu/presentations/rrp_hapl0501.pdf, 12 pages (2001).

Singer, "Z Produces Fusion Neutrons, Sandia Scientists Confirm; Announcement to be Made Sunday at APS Meeting," Sandia Lab News 55(7), 16 pages (2003).

Stoldt et al., "Novel Low-Temperature CVD Process for Silicon Carbide MEMS," Department of Chemical Engineering, University of California, Berkeley, 4 pages.

Sullivan et al., "Amorphous Diamond MEMS and Sensors," Sandia National Laboratories, SAND2002-1755, 42 pages (2002).

"Topic 6.5: Pressure Vessels—Thin Wall Pressure Vessels," Statics & Strength of Material, University of Wisconsin-Stout Physics Department, available at http://www.uwstout.edu/faculty/scotta/upload/Foley-StaticsStrengths.pdf, 4 pages.

U.S. Appl. No. 11/046,526, filed Jan. 28, 2005 by Kley, now abandoned (unpublished).

U.S. Appl. No. 11/067,517, filed Feb. 25, 2005 by Kley, now abandoned (unpublished).

"Z Machine Melts Diamond to Puddle," Sandia National Laboratories News Release, 2 pages (2006).

U.S. Appl. No. 14/203,440 , "Non-Final Office Action", dated Dec. 11, 2015, 7 pages.

U.S. Appl. No. 14/203,440 , "Notice of Allowance", dated Jun. 15, 2016, 5 pages.

U.S. Appl. No. 15/289,924, "Non-Final Office Action", dated May 23, 2017, 6 pages.

* cited by examiner

USER IDENTIFICATION FOR WEAPONS AND SITE SENSING FIRE CONTROL

CROSS REFERENCE TO RELATED APPLICATIONS

This application is a continuation-in-part of U.S. patent application Ser. No. 14/203,440, filed Mar. 10, 2014 for "Molded Plastic Cartridge with Extended Flash Tube, Sub-Sonic Cartridges, and User Identification for Firearms and Site Sensing Fire Control" (Victor B. Kley), which claims priority to U.S. Provisional Patent Application No. 61/787,459, filed Mar. 15, 2013 for "Molded Plastic Cartridge with Extended Flash Tube, Sub-Sonic Cartridges, and User Identifications for Firearms and Site Sensing Fire Control" (Victor B. Kley). The entire disclosures of the above applications are hereby incorporated by reference for all purposes.

TABLE OF CONTENTS

Cross Reference to Related Applications
Background of the Invention
Summary of the Invention
Brief Description of the Drawings
Description of Specific Embodiments
What is Claimed is:
Abstract of the Disclosure This application incorporates by reference the entire disclosures of the following U.S. patents and patent applications for all purposes:

- U.S. Pat. No. 7,441,362, filed Mar. 25, 2005, entitled "Firearm with Force Sensitive Trigger and Activation Sequence" (Victor B. Kley), which claims the benefit of U.S. Provisional Application No. 60/557,470, filed Mar. 29, 2004, entitled "Diamond and/or Silicon Carbide Molding of Small and Microscale or Nanoscale Capsules and Other Objects Including Firearms" (Victor B. Kley); and
- U.S. Pat. No. 7,926,408, filed Nov. 28, 2006, entitled "Velocity, Internal Ballistics and External Ballistics Detection and Control for Projectile Devices and a Reduction in Device Related Pollution" (Victor B. Kley), which claims the benefit of U.S. Provisional Application No. 60/740,586, filed Nov. 28, 2005, entitled "Velocity, Internal Ballistics and External Ballistics Detection and Control for Projectile Devices and a Reduction in Device Related Pollution" (Victor B. Kley).

The present disclosure is related to the following U.S. patent applications, the entire disclosures of which are incorporated by reference for all purposes:

- U.S. patent application Ser. No. 11/046,526, filed Jan. 28, 2005 for "Angle Control of Multi-Cavity Molded Components for MEMS and NEMS Group Assembly" (Victor B. Kley); and
- U.S. patent application Ser. No. 11/067,517, filed Feb. 25, 2005 for "Diamond Capsules and Methods of Manufacture" (Victor B. Kley).

The entire disclosures of the following U.S. Patents are incorporated by reference for all purposes:

- U.S. Pat. No. 4,149,465, issued Apr. 17, 1979, entitled "Ammunition Cartridge" (Jay M. Verkozen);
- U.S. Pat. No. 6,845,716, issued Jan. 25, 2005, entitled "Ammunition Articles with Plastic Components and Method of Making Ammunition Articles with Plastic Components" (Nabil Husseini, David E. Byron);

- U.S. Pat. No. 7,204,191, issued Apr. 17, 2007, entitled "Lead Free, Composite Polymer Based Bullet And Method Of Manufacturing" (Sy Wiley, William E. Rembert, III); and
- U.S. Pat. No. 7,213,519, issued May 8, 1979, entitled "Composite Polymer Based Cartridge Case Having an Overmolded Metal Cup, Polymer Plug Base Assembly" (Sy Wiley, William E. Rembert, III, Gary Loftin).

The following document is incorporated by reference in its entirety for all purposes:

- "Velocity and Pressure Effects on Projectiles due to Variation of Ignition Parameters," Richard Otis Culver, Jr., and Raymond M. Burns, Naval Postgraduate School, Monterey, Calif. (December 1972), Master's thesis, NIST No. 757278 (http://www.dtic.mil/dtic/tr/fulltext/u2/757278.pdf).

BACKGROUND OF THE INVENTION

The present invention relates in general to firearms and other projectile weapons (such as rail guns, gas weapons, air guns, Tasers or similar weapons, projected energy weapons, and the like), and more particularly to weapons incorporating sensors and logic that can constrain the circumstances under which the weapon can be fired.

From shotguns to rifles to handguns, firearms and other projectile or projectile-like weapons have proven to be a valuable tool for law enforcement and self-defense. Sadly, however, firearms have also proven to be a valuable tool for criminals, who use them to threaten, injure, or murder their victims. In addition, many people are injured or killed each year through accidental discharge of firearms, including children playing with a parent's gun.

Attempts to solve these problems include trigger locks and gun safes. While they are of some help, both solutions are imperfect. Trigger locks and gun safes, for example, keep unauthorized users (particularly children) from operating a firearm or other weapon, but they can also interfere with legitimate users' ability to respond quickly to a deadly threat. Further, because a criminal can steal a weapon or a gun safe and remove the lock at his or her leisure, trigger locks and gun safes do little to prevent stolen weapons from being used in further crimes.

Therefore, it would be desirable to provide weapons with improved protection against unauthorized use.

SUMMARY OF THE INVENTION

In short, embodiments incorporate mechanisms to enhance the safety of weapons, for example to control the users that are permitted to use the weapon or to limit the locations and directions of aiming the weapon. In this context, the term weapon is intended to cover a range of weapons beyond firearms and other projectile-launching (including steerable projectiles) weapons. Included in the definition are devices that launch barbs attached by wires to an electrical source (e.g., Tasers), lasers and other electromagnetic beam devices such as gamma ray guns, and particle beam devices (e.g., alpha particles, electrons) or hybrids of the latter well known weapons.

In one embodiment of the invention, the firearm includes a specially designed trigger capable of verifying a user's identity so that only an authorized user can discharge the firearm. For example, the firearm can be programmed with a time sequence of pressures (which may vary or remain constant) that a user exerts on the trigger to activate the firearm. In a further embodiment and in conjunction with a piezoelectric structure pressed or attached rigidly to the trigger pressure and vibration may be sent back to the users trigger finger to signal that a pressure stage has been reached, or that ammunition is running low or is out. Further the trigger can be used to set the force for the trigger firing in one or more stages. By feeding back different vibrations other parameters and controls can be set up. All these various programming or setting methods would only occur from set safe conditions.

In another embodiment of the invention, a weapon is configured with a restricted area automatic fire disable function. The weapon uses sensors to determine the location of the weapon, the angle with respect to a plane parallel to the earth, and the direction and range of the projectile or other launched beam if fired at any given moment along with the rate of change of the angle and direction whenever the weapon is within striking distance at the most favorable angle with respect to the restricted area and any area within the restricted area. So for example a weapon with a best range of 2 miles (a 2 mile circle) would not function if pointed and angled such that it could enable a hit on any portion of a restricted area. This is the case, even though the restricted area is substantially smaller then the range area which can be said to move and align with the pointing direction of the weapon.

In another embodiment, the weapon can use its emergency broadcast capability to signal on the emergency frequencies its presence and the need for assistance. This signal can be commanded by the user or if the weapon is dropped or simply left unattended for a programmable time. Thus a dropped, stolen, or lost weapon can be quickly located and recovered.

In another embodiment, the weapon includes a sighting system with an included optical presentation of the status of the weapon including fire system on/off, shots remaining. It also includes an audio system bi-directionally communicating to earbuds or headset, or through bone conduction in the stock (of a rifle like weapon) near the cheek rest. The weapon will learn the unique voice characteristics of each authorized user whose voice will be part of the enabling process, and will subsequently be able to directly request services such as emergency beacon, cartridges or charge or gas or air reserves remaining. Voice may command trigger release force, number of stages in the trigger release for a time set up by the authorized user. For example, fire is enabled by a commend on or off for hours or days, but otherwise stays fire disabled to anyone failing to know the quick enable pass codes (voice in combination with pressure pattern on trigger).

A further understanding of the nature and advantages of the present invention may be realized by reference to the remaining portions of the specification and the drawings, which are intended to be exemplary and not limiting.

DESCRIPTION OF SPECIFIC EMBODIMENTS

The related patent applications incorporated by reference above describe, inter alia: various techniques and apparatus for a pressure sensitive trigger (U.S. Pat. No. 7,441,362). In embodiments of the present invention, such techniques can be used.

Figure 1:
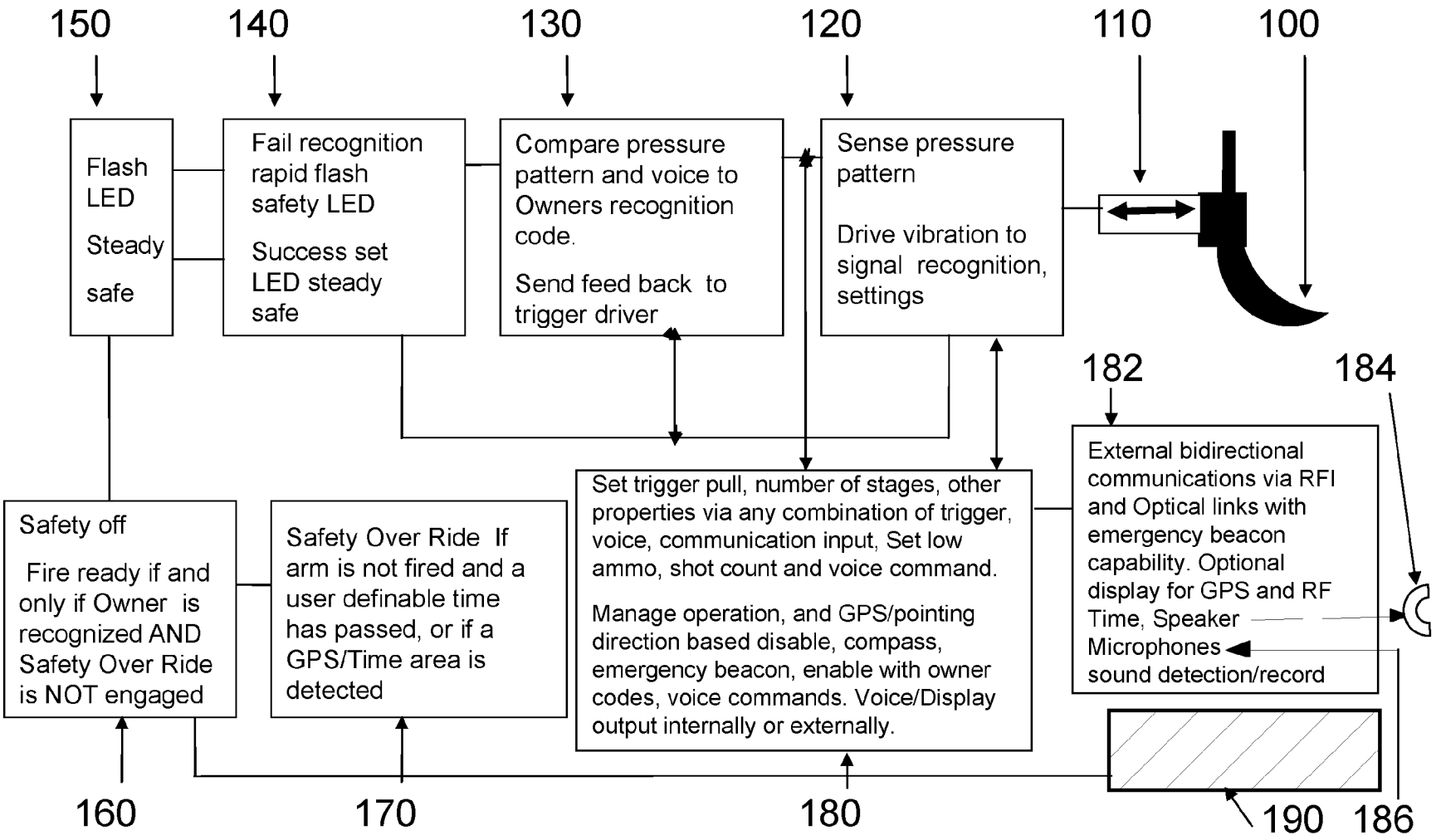
FIG. 1 is a view of a pressure sensitive electronic trigger with vibration feedback according to an embodiment of the present invention.

FIG. 1 shows a schematic and flow chart of the trigger with a stainless steel boss 100 and the piezoelectric sensor/transducer 110 proceeding through a logic that culminates in permitting the safety to be placed in the off state and firing the weapon through electromechanical fire mechanism or in an alternative embodiment an electrically ignited cartridge.

Figure 2:
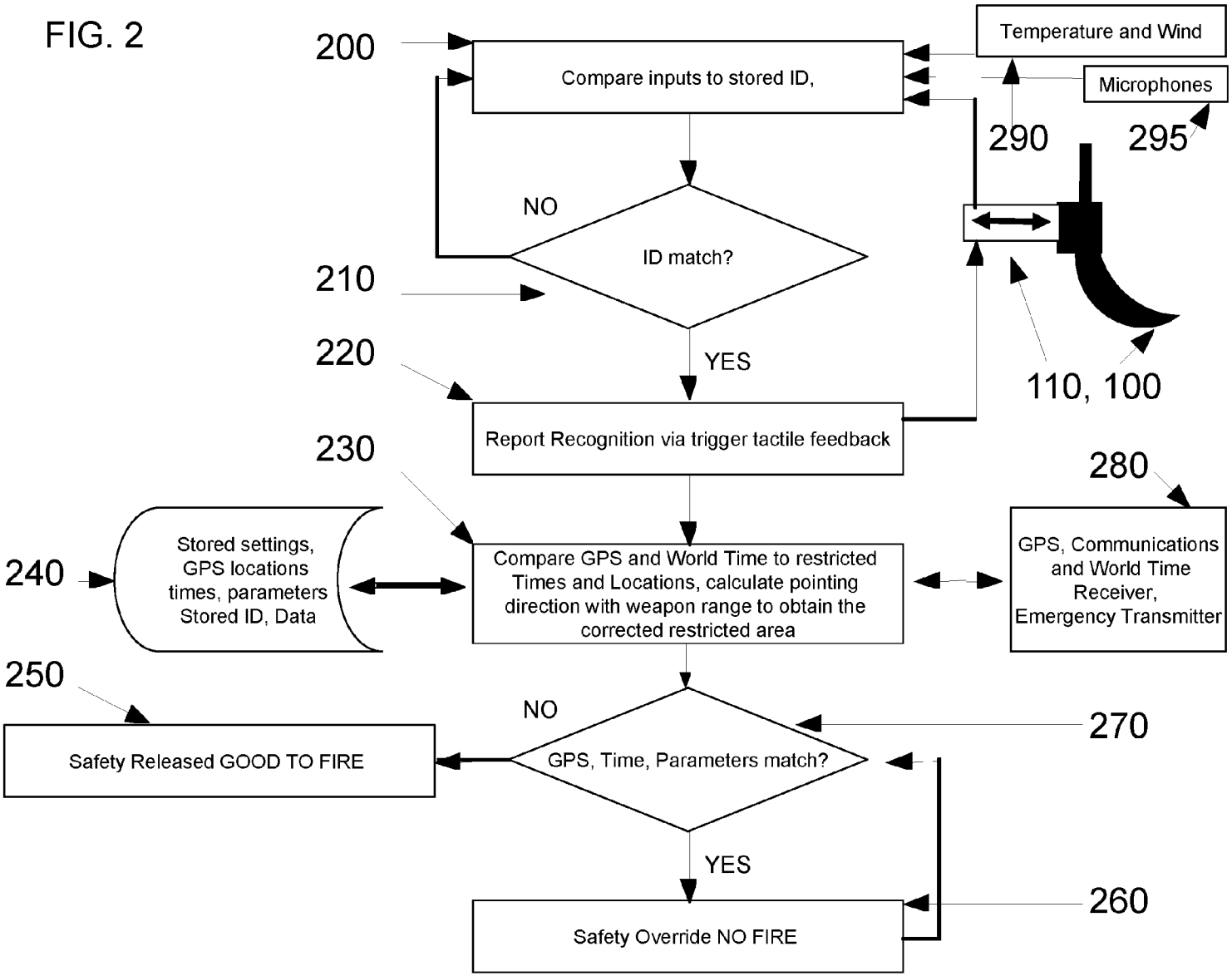
FIG. 2 is a view of a process flow of the electronic trigger with vibration feedback, microphones, global positioning sensor, radio frequency clock sensor, emergency transmitter, temperature and wind speed and direction sensor, and safety according to an embodiment of the present invention.

FIG. 2 shows the process logic as a classic process flow chart which includes most of the embodiments in the invention.

Figure 3:
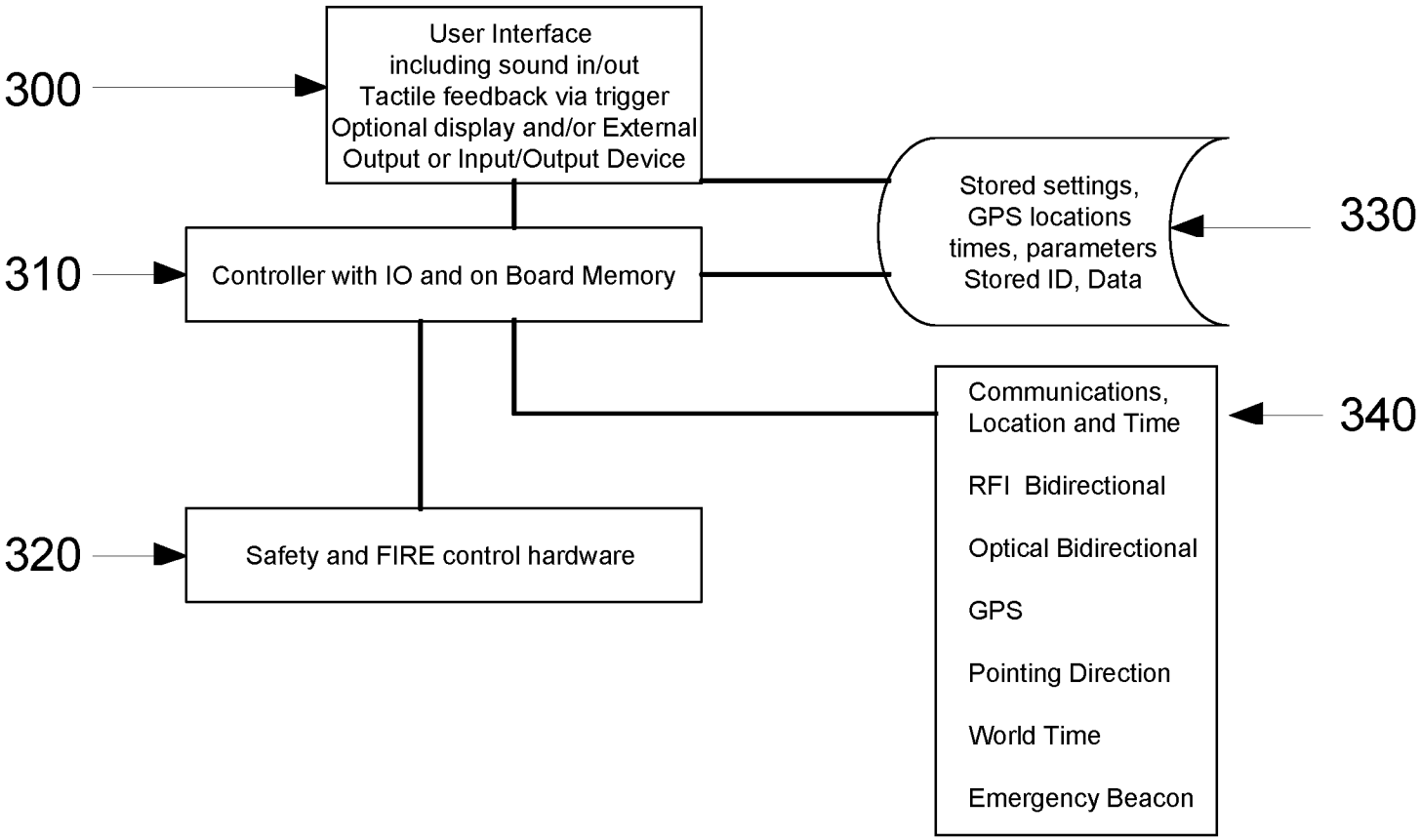
FIG. 3 is a view of a microcontroller, main memory with information including restricted no fire areas and times, optional data display, sound input and output and fire control hardware according to an embodiment of the present invention.

FIG. 3 shows the operational logic blocks used in the preferred embodiment. The microcontroller 310 and User Interface 300 which includes tactile feedback, sound in and out and an optional data display both interact with the main memory 330 to record each shot with a time and pointing direction and full GPS location. The fire and safety control circuitry 320 is where the microcontroller 310 sends control information to fire or go to safe mode.

Embodiments of the present invention can utilize details of complementary laws or governmental regulations at the state, national, and international levels providing greater freedom of operation for defense, and other legitimate uses of the weapon because of the unique safety qualities of the weapon. Such laws permit action ready weapons to be kept ready for authorized users close at hand in homes, small and large businesses, and vehicles. The users of these operational weapons can be secure in the knowledge that such weapons cannot be used by children, thieves, or any agent other then the authorized users for which the weapon has trained recognition systems.

In operation, a force sensing trigger 100, which may include a piezoelectric 110 or piezoresistive element is pressed and changes output voltage or resistance as a function of the applied pressure, one or more times in an activation sequence. The activation sequence includes a specific pattern of pressures or pulses on the trigger 100, and the pattern may be defined by reference to a relative duration of the pulses and/or relative force on the trigger as a function of time. In addition in the preferred embodiment one or more voice commands can be sensed by one or more microphones 186. The activation sequence or owners recognition code is advantageously preprogrammed by the user, e.g., upon purchasing the firearm, and stored in memory in control logic 120-180.

When trigger 100 is operated, signals representing the force as a function of time are transmitted to control logic section 120, and thence to 130 which compares them to the activation sequence, with the firearm becoming usable only when the trigger operations match the preprogrammed activation sequence and is sent to logic in 140 and 150. Finally the arm is fired, after a second check of owner recognition at 160, by the action of electromechanical elements at 190 which release a spring loaded firing pin, or hammer.

Alternatively, the firing pin may be part of a solenoid and be electrically actuated. In yet another embodiment the ignition may be initiated by an electrical current for example causing thin magnesium wire to vaporize thus setting off the primer material or with sufficient flash magnesium wire the gunpowder directly. One or more program controlled safeties are turned to on or Safe position if the arm is not fired and a preset time has elapsed 170. 170 also treats the use of the GPS sensor to determine the position and orientation of the firearm along with the time and compare that time and location to a table of restricted GPS locations. In addition as shown in 230 FIG. 2 actual Global Positioning (GPS) coordinates and World time is compared to one or more tables of locations stored in memory 240, each coordinate has one or more parameters indicating the area around the stored table coordinate which is restricted and the Greenwich Mean time range if any when the restriction is lifted.

In addition to the restricted areas (if any) there are also owner defined locations which are entirely unrestricted. As an example one table of GPS coordinates parameters and times in one embodiment will be all the schools, malls, hospitals, doctors offices, clinics, all sites where large crowds gather together, ballparks, museums, music halls, playgrounds, and theatres in North America. Based on the 2010 school count in the U.S. of 98,817 public schools the total estimate for North America is 950,000 such sites. Each site will require 200 bytes of information including the site location, time of restriction, a described polygon which includes any legally required distance for firearms creating the need for 190 megabytes of memory space for such or far less memory then is commonly used in most low cost electronic devices today. In one embodiment the arm will also note when the weapon is pointed at a restricted region and prevent firing if the range to the restricted area is smaller than the range for the cartridge used in the firearm.

The activation sequence acts as a "password" with both or either voice and trigger pressure to prevent the firearm from being used by anyone other than an authorized user. After the owner is recognized the trigger pull and one or more stages of pull may be set 180 by putting in the trigger set sequence, followed by the number of stages (1 to 4) the trigger will then vibrate to indicate the stage and the owner then simply presses the trigger to set the force to fire (last stage) or to move to the next stage, note that when in these setting sequences the safety is always on and firing is fully inhibited. If the activation sequence is not recognized then logic in 140 commands the drivers in 150 to flash the safety LED, if recognized the LED is steady but in both cases the safety is set and must be release by the shooter.

In an additional embodiment programmable logic in 180 in conjunction with sensors in the magazine or on the frame of a revolver looking in the chambers not in battery permits the arm to notice ammo out, remaining ammo or last round as trigger back pressure giving notice to the shooter. Also LED flash and LED steady may be replaced by a vibration or series of vibrations indicating that the safety is on, that is fed back to the trigger finger. Thus if password enabled every time the trigger is pressed when the safety is on, the signal of safety on is sent to the finger.

In a further embodiment the mechanical safety which blocks the firing pin of the weapon must be cycled on and then off (ready to fire) before the weapon will fire for the first time after the owners code is entered. The position of the mechanical safety is detected optically or electronically and the resultant electronic signal is sent to the logic of the electronic recognition trigger. In an additional embodiment the trigger is vibrated to indicate a safe state (safety on firing disabled) for an preset (but programmable) time after the arm is enabled and in the dark (as sensed by a phototransistor). In yet another embodiment, the safety display may be any combination of passive mechanical, electrophoretic, liquid crystal, OLED, electroluminescent and LED displays. In an alternate embodiment displays and/or speaker 184 are used to report the GPS position and with the display the nearest known roads. In an alternative embodiment microphones and trigger can be used to select the emergency beacon 184 or transmitter 280 function in those firearms, typically rifles, where antenna and adequate power is available from batteries, supercaps, and small stock mounted solar panels.

In operation then in FIG. 3 the system uses logic provided by a programmed microcontroller 310, initiated and reporting through a User Interface 300 which makes commands through trigger pressure and voice to the controller 310 and based on the proper activation sequence the controller enables firing of the weapon. The controller uses information provided by the sensors including GPS, World time, and can bidirectionally communicate via RF or Optical links to nearby devices and networks. Information about settings and nearby GPS and Time restrictions are loaded from 330 by the controller 310. When all conditions are met the controller 310 can command the Fire control hardware to permit the safety to be set to off and can, when the trigger is pressed to the preset force for the final stage (there will be at least 1 stage for firing the gun), fire a round from the firearm.

While the invention has been described with respect to specific embodiments, one skilled in the art will recognize that numerous modifications are possible. One skilled in the art will also recognize that the present invention provides a number of advantageous techniques, tools, and products, usable individually or in various combinations. These techniques, tools, and products include but are not limited to:

- a weapon controlled by a pressure or force sensitive trigger; and/or
- a weapon in which a particular time series of pressures on the trigger (which may be varying or non-varying pressures) and/or voice commands causes a particular action including but not limited to making the weapon operational for firing; and/or
- a weapon in which a particular time series of pressures on the trigger (which may be varying or non-varying pressures) and/or voice commands causes a particular action, including but not limited to setting the trigger pressure and/or setting any other parameters and/or determining the GPS location and Greenwich Mean Time of the weapon, and wherein the trigger pressure and/or other parameters and/or the GPS location and/or the Greenwich Mean Time is spoken and/or displayed on an attached digital display; and/or
- a weapon in which the actual GPS location and time are compared to a database of such locations and proscribed distances, time and the operational range of the weapon at the location including altitude is made and firing is disabled until such time as the weapon is outside the latter calculated area or turned away from the proscribed area, time of allowed firing is found to correspond to the actual time or a location is reached in which operation of the weapon is enabled; and/or
- a weapon in which each shot includes a captured shot sound which is recorded with time stamp, and firearm direction and location; and/or
- a weapon in which an emergency beacon is built in and can be turned on by trigger pressure sequence and/or by voice command; and/or
- a weapon in which bidirectional links permit the status and location of the arm to be set and queried over Radio Frequency and Optical links including WiFi, cell phone systems, Bluetooth and Wide Area Networks; and/or a weapon in which the trigger pressure and number of stages of trigger can be set via trigger sequence, voice or communication input; and/or a weapon that measures temperature and wind (direction and force) and displays them or says them to the user, and uses this information in calculating the threat to proscribed areas.

While the above is a complete description of specific embodiments of the invention, the above description should not be taken as limiting the scope of the invention as defined by the claims.

What is claimed is:

1. A weapon comprising:

a firing mechanism that, when activated, causes launching of a projectile or energy beam to follow a predictable path;

a piezoelectric structure to detect pressure applied by a trigger finger of an operator; and an electronic logic circuit that controls the firing mechanism, wherein the electronic logic circuit is coupled to the piezoelectric structure and configured to:

sense a particular time series of pressures using the piezoelectric structure;

determine, based at least in part on the sensed time series of pressures, whether the operator is authorized to fire the weapon; and activate the firing mechanism only if the operator is authorized to fire the weapon.

2. The weapon of claim 1 wherein the electronic logic circuit is further configured to cause tactile feedback confirming authorization to be made to the trigger finger by vibrating a trigger.

3. The weapon of claim 1 wherein the electronic logic circuit is further configured to perform one or more of the following actions in response to an input from the operator, wherein the input from the operator includes one or both of pressure detected by the piezoelectric structure or a voice command detected using a microphone:

setting the trigger pressure;

setting any other parameters;

determining the GPS location and Greenwich Mean Time of the weapon; or displaying the GPS location and Greenwich Mean Time on an attached digital display.

4. A weapon for launching a projectile or energy beam to follow a predictable path, the weapon comprising:

a firing mechanism that, when activated, causes launching of the projectile or energy beam;

a force-sensing trigger;

a storage medium for storing a representation of restricted areas;

a location-sensing element for determining a current location of the weapon;

a direction-sensing element for determining a current direction in which the weapon is pointed; and control and sensing logic that is configured to:

compare the current location with the stored restricted areas, in response to the current location falling within one of the restricted areas, prevent activation of the firing mechanism, prevent activation of the firing mechanism when the weapon is not within a given restricted area, but the current direction and the distance from the given restricted area are such that a launched projectile or energy beam would enter the given restricted area; and prevent activation of the firing mechanism unless an operator establishes authorization using one or both of an applied pressure on the force-sensing trigger or voice input.

5. The weapon of claim 4 wherein the control and sensing logic is also configured to:

maintain the non-activation for an extended time.

6. The weapon of claim 4 wherein the control and sensing logic is also configured to:

prevent any activation of the firing mechanism when the weapon is deactivated and there is a sustained loss of GPS signal.

7. The weapon of claim 4 wherein the control and sensing logic is also configured to:

detect a fall or being dropped and disable any firing while setting an emergency radio beacon to operate until such time as the user reenters an enabling code outside a restricted area plus an additional range.

8. The weapon of claim 1 wherein the electronic logic circuit is also configured to maintain the non-activation for an extended time if the operator is not authorized to fire the weapon.

9. The weapon of claim 1 wherein the electronic logic circuit is also configured to prevent any activation of the firing mechanism when the weapon is deactivated and there is a sustained loss of GPS signal.

10. The weapon of claim 1 wherein the electronic logic circuit is also configured to detect a fall or being dropped and disable any firing while setting an emergency radio beacon to operate until such time as the user reenters an enabling code outside a restricted area plus an additional range.

11. The weapon of claim 1 wherein the electronic logic circuit is further configured to receive voice information from the operator and wherein determining whether the operator is authorized to fire the weapon is based in part on the voice information and in part on the sensed pressure.

12. The weapon of claim 11 wherein the electronic logic circuit is further configured such that determining whether the operator is authorized to fire the weapon is based on sensing a particular time series of pressures on the piezoelectric structure and the voice information.

13. The weapon of claim 2 wherein the electronic logic circuit is further configured to cause auditory confirmation confirming authorization to be made via speaker.

* * * * *